US006771253B2

(12) United States Patent
Wu

(10) Patent No.: US 6,771,253 B2
(45) Date of Patent: Aug. 3, 2004

(54) SWITCH HAVING LIGHT GENERATOR

(75) Inventor: Ming-Hui Wu, Hsien-Tien (TW)

(73) Assignee: Shin Jiuh Corp., Taipei Hsien (JP)

( * ) Notice: Subject to any disclaimer, the term of this patent is extended or adjusted under 35 U.S.C. 154(b) by 255 days.

(21) Appl. No.: 09/993,568

(22) Filed: Nov. 27, 2001

(65) Prior Publication Data

US 2003/0098843 A1 May 29, 2003

(51) Int. Cl.[7] ..... G09G 5/00
(52) U.S. Cl. ..... 345/170; 200/341
(58) Field of Search ..... 345/156, 160, 345/168, 169, 172, 161, 170; 200/5 R, 6 R, 6 A, 341; 463/36, 37, 38

(56) References Cited

U.S. PATENT DOCUMENTS 4,431,879 A * 2/1984 Fujita et al. ..... 200/341
6,096,985 A * 8/2000 Ritter et al. ..... 200/6 A
6,335,500 B1 * 1/2002 Chi et al. ..... 200/341
6,377,823 B1 * 4/2002 Higuchi et al. ..... 455/567

* cited by examiner

*Primary Examiner*—Chanh Nguyen
(74) *Attorney, Agent, or Firm*—Birch, Stewart, Kolasch & Birch, LLP

(57) ABSTRACT

A switch comprises a seat, a key body, a first elastomer, a second elastomer, and a cover. A neck portion of the key body has an assembling portion, and the assembling portion is installed with the light generator. As the key body is pushed, the second elastomer will contact the cover; the positive (negative) power connected to a conductive piece will be transferred to the positive (negative) end of the light generator. At the same time, the first elastomer contacts internal wires of a first receiving portion so as to provide negative (positive) power to the negative (positive) ends of the light generator. Then, electric signals are outputted and the light generator lights up.

9 Claims, 6 Drawing Sheets

SWITCH HAVING LIGHT GENERATOR

FIELD OF THE INVENTION

The present invention relates to a switch, and particularly to a switch having a light generator that lights up as the switch is actuated.

BACKGROUND OF THE INVENTION

Currently, switches are widely used in computer devices and mobile phones for switching the functions on a window or selecting icons on the windows.

Generally, the prior switch includes a seat, a key body, a first elastomer, a second elastomer, and a cover for controlling the switching of various functions or selection desired items. In operation, as the key body is pushed, a neck portion 22 of the key body 2 will move in a space of the seat 1 so as to drive the rotary portion 23 to rotate. When the rotary portion 23 rotates, the free ends of the second elastomer 4 extend toward a second receiving portion 13. A contact end of the first elastomer 3 firmly secured to the back surface of the rotary portion 23 contacts the interior of the first receiving portion 12. Then, an electric signal is outputted, this signal is used for switching the functions on a window or selecting icons on the windows.

Although this switch serves for switching the functions on a window or selecting icons on the windows, the user cannot know whether this switch has faults. It must be monitored by a window. Sometimes, disabling of the window is not induced from the destroy of the switch.

The seat 1 has a solid portion 11. The solid portion 11 is formed with a first receiving portion 12 and a second receiving portion 13. The bottom of the first receiving portion 12 has a conductive wires 121. This conductive wires 121 is communicated with a pin 14 so as to form an power input and an output of control signal. The solid portion 11 is installed with a space 15 at position with respect to the first receiving portion 12 for operating the key body 2. The first receiving portion 12 has a pivotal shaft 16 pivotally connected to the key body 2. Moreover, the bottom of the solid portion 11 has a buckling portion 17.

SUMMARY OF THE INVENTION

Accordingly, the primary object of the present invention is to provide a switch with a light generator. As the switch is actuated, the light generator will light up to inform the condition of the switch and to present a vivid feeling.

Another object of the present invention is to provide a switch having a light generator with two displaying colors which is used for displaying a correction operation and an incorrect operation.

To achieve above object, the present invention provides a switch comprising a seat, a key body, a first elastomer, a second elastomer, and a cover. A neck portion of the key body has an assembling portion, and the assembling portion is installed with the light generator. As the key body is pushed, the second elastomer will contact the cover; the positive (negative) power connected to a conductive piece will be transferred to the positive (negative) end of the light generator; at the same time, the first elastomer contacts internal wires of a first receiving portion so as to provide negative (positive) power to the negative (positive) ends of the light generator; then, electric signals are outputted and the light generator lights up.

The various objects and advantages of the present invention will be more readily understood from the following detailed description when read in conjunction with the appended drawing.

DETAILED DESCRIPTION OF THE PREFERRED EMBODIMENTS

Figure 1:
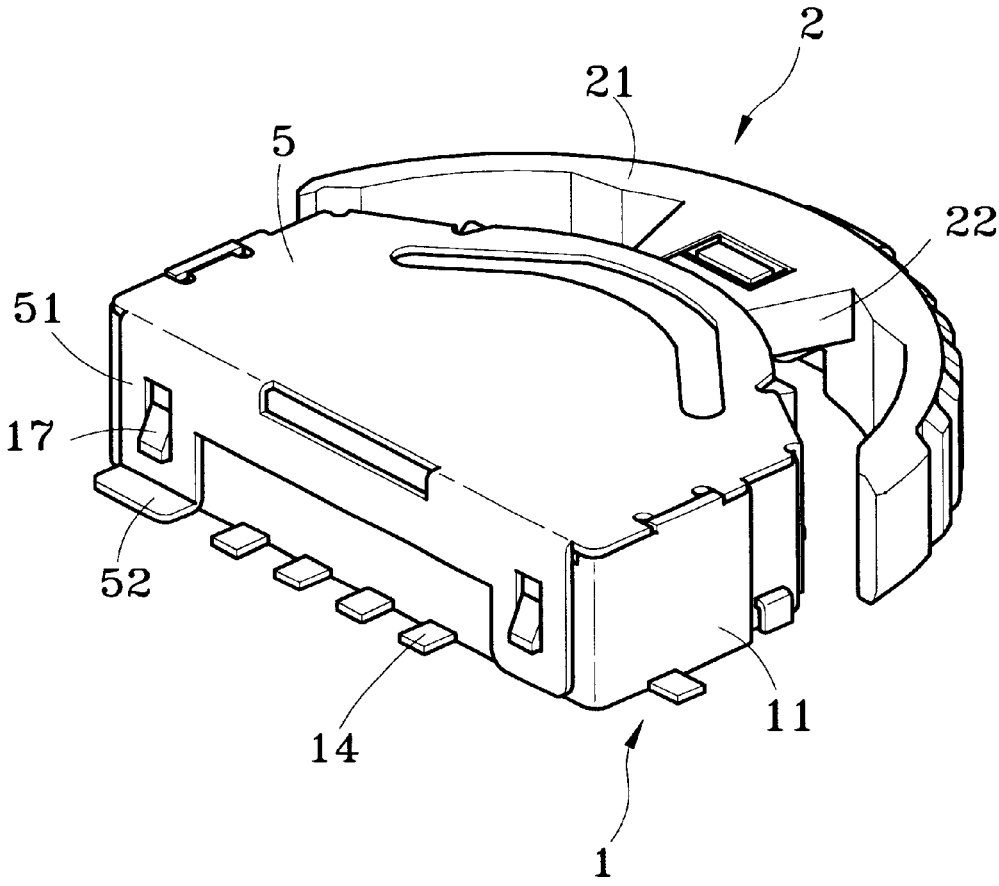
FIG. 1 is a schematic perspective view of the switch of the present invention.
Figure 2:
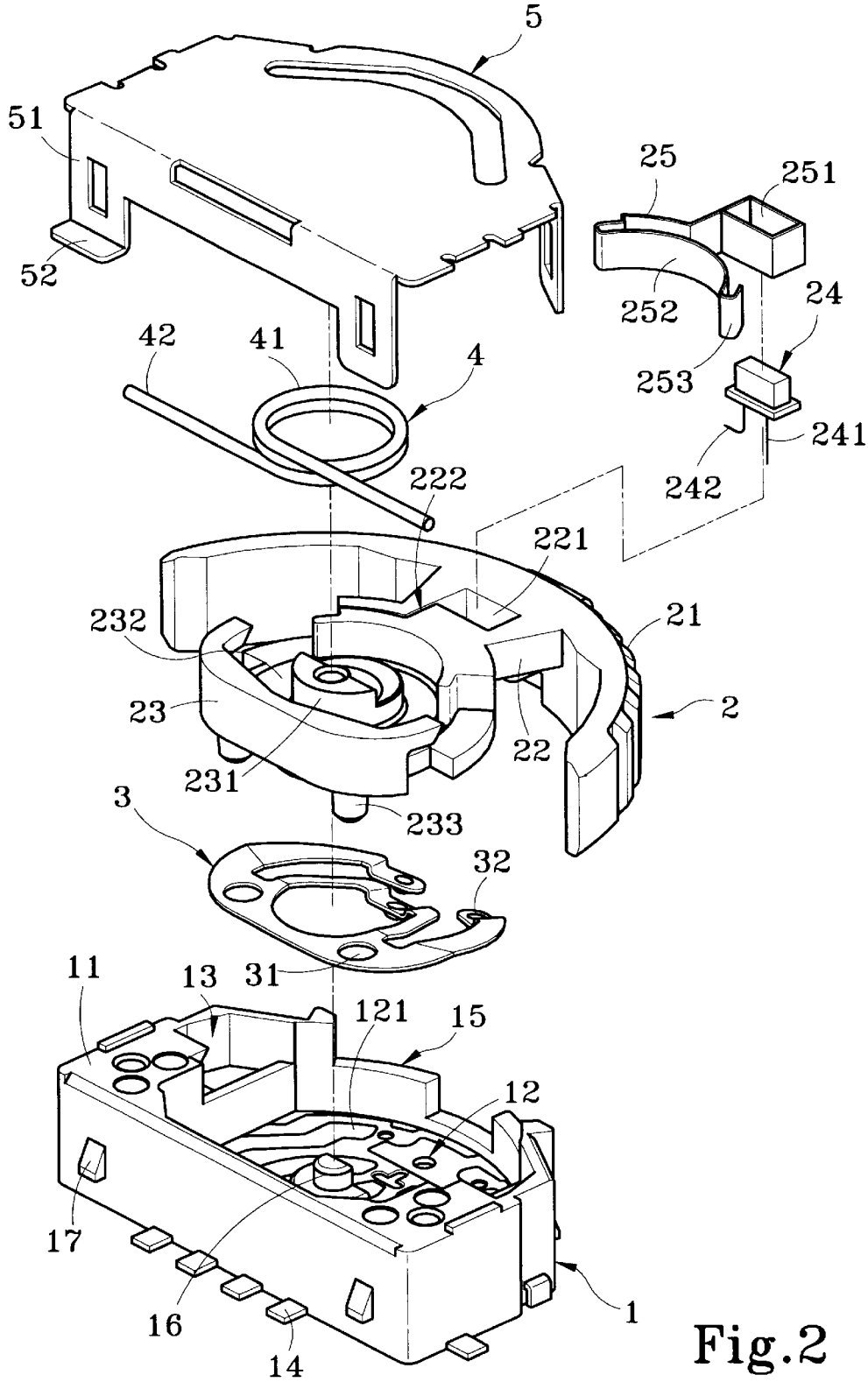
FIG. 2 is an exploded perspective view of FIG. 1.

Referring to FIGS. 1 and 2, the perspective view and exploded schematic view of the present invention are illustrated. The switch of the present invention includes a seat 1, a key body 2, a first elastomer 3, a second elastomer 4, and a cover 5 for controlling the switching of various functions or selection desired items. In operation, a light generator 24 is arranged within the key body 2. As the key body 2 is pushed, the light generator 24 will generate light for representing that the switch is actuated. At the same time, the light increases the activity of the application.

The seat 1 has a solid portion 11. The solid portion 11 is formed with a first receiving portion 12 and a second receiving portion 13. The bottom of the first receiving portion 12 has a conductive wires 121. The conductive wires 121 are communicated with a pin 14 so as to form an power input and an output of control signal. The solid portion 11 is installed with a space 15 at position with respect to the first receiving portion 12 for operating the key body 2. The first receiving portion 12 has a pivotal shaft 16 pivotally connected to the key body 2. Moreover, the bottom of the solid portion 11 has a buckling portion 17.

The key body 2 has a cambered key cap 21. The key cap 21 is connected with a neck portion 22. The neck portion 22 is connected to a rotary portion 23. The rotary portion 23 is installed with a pivotal portion 231 pivotally connected to the pivotal shaft 16. One periphery of the pivotal portion 231 is formed with a movable portion 232. The neck portion 22 is formed with an assembling portion 221 penetrating through the surface of the key cap 21. The assembling portion 221 is extended with an embedding portion 222. The embedding portion 222 is embedded with a conductive piece 25. After the embedding portion 222 is embedded with the conductive piece 25, a hollow engaging portion 251 at one end of the conductive piece 25 is assembled to the assembling portion 221. The contact portion 252 at another end of the conductive piece 25 is adhered to the bottom of the neck portion 22. One end of the contact portion 252 has a buckling portion 253. The buckling portion 253 can be buckled to the lateral side of the bottom of the neck portion 22 for preventing the conductive piece 25 from releasing or loosing. The light generator 24 formed by light emitted diodes or bubbles is arranged within the engaging portion 251. The negative (positive) end of this light generator 24 is connected to the engaging portion 251 of the conductive piece 25. The positive (negative) end of the light generator 24 is connected to the first elastomer (floating contact point) 3.

The first elastomer (floating contacting point) 3 has a set of symmetrical positioning portions 31 for positioning the concave portion 233 at the back surface of the rotary portion 23. A pair of symmetric contact ends 32 extends from the first elastomer 3. The contact ends rotate with the rotary portion 23 to contact the wire 121 in the first receiving portion 12. Thereby, a signal of keying is outputted.

The second elastomer 4 is arranged in the movable portion 232 and has a winding portion 41. The winding portion 41 is arranged at an outer edge of the pivotal portion 231. Two free ends 42 of the winding portion 41 are pivotally connected to the second receiving portion 13. The second elastomer 4 is arranged in the movable portion 232. The top portion of the winding portion 41 is in contact with the contact portion 252 of the conductive piece 25.

The cover 5 has a plurality of buckling portions 51 which are buckled to the buckling portion 17 of the seat 1. Thereby, the cover 5 is firmly secured to the seat 1. Then a connecting piece 52 is extended from any one of the buckling portion 51. Thereby, the connecting piece is connected with a positive or a negative polarity. Therefore, a switch is formed.

Figure 3:
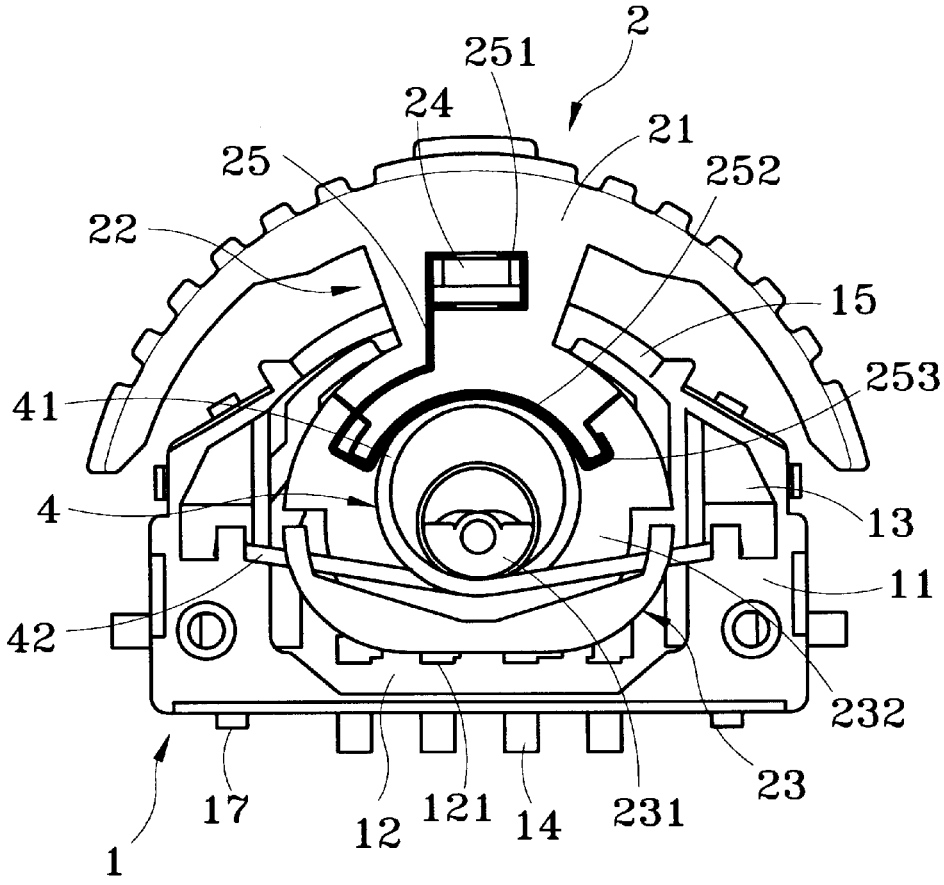
FIG. 3 is an assembled schematic view of FIG. 2, wherein the cover is uncovered.
Figure 4A:
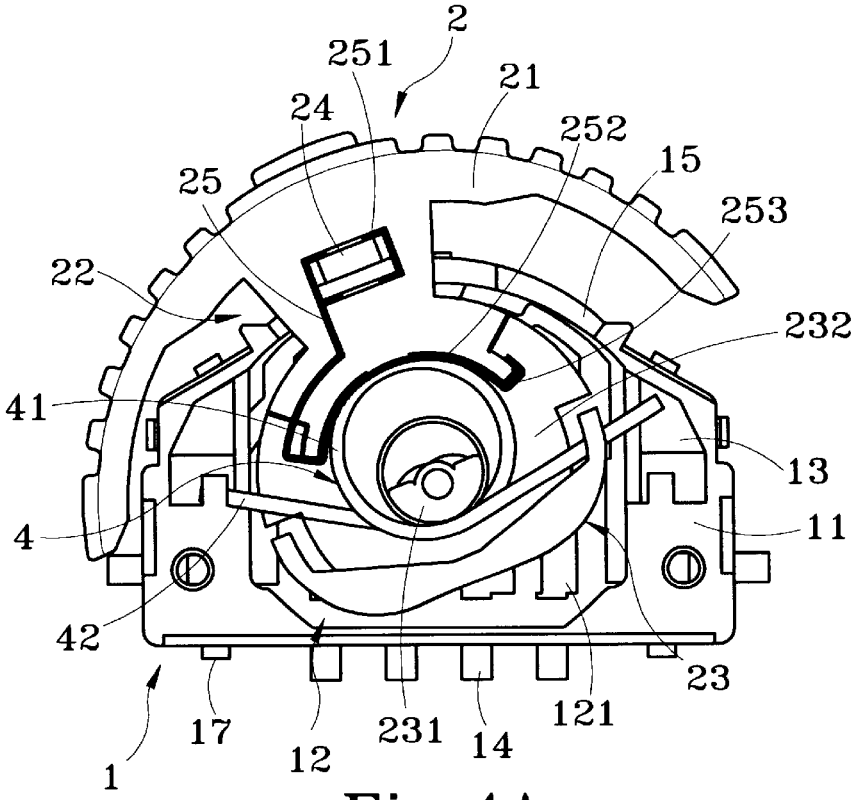
FIG. 4A is a schematic view showing the operation of FIG. 3.
Figure 4B:
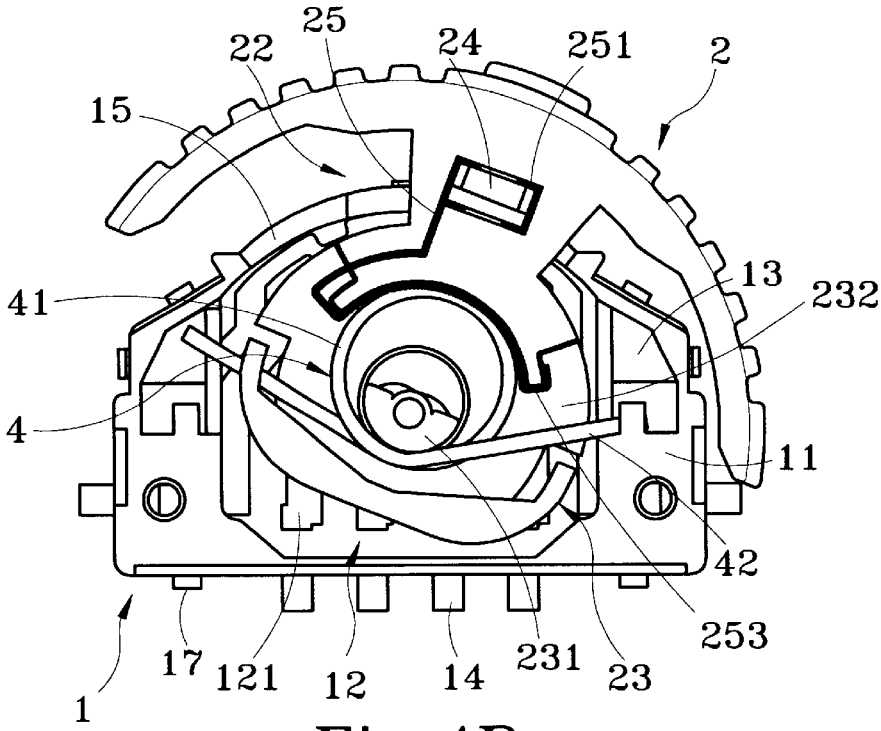
FIG. 4B is another schematic view showing the operation of FIG. 3.

Referring to FIGS. 3, 4A, 4B, the schematic views showing the structure of FIG. 1 without any cover and the application of FIG. 3. As shown in the figures, the key body 2, light generator 24, first elastomer (floating contact point) 3, second elastomer 4 are assembled to the seat 1. The connecting piece 52 of the cover 5 is conductive with positive (negative) power, while the wire 121 in the first receiving portion 12 is conductive with negative (positive) power. As the key cap 21 of the key body 2 moves due to a force applying thereon, the rotary portion 23 is driven to rotate. As the rotary portion 23 rotates, the free ends 42 of the second elastomer 4 extend toward the second receiving portion 13. Then, the winding portion 41 of the second elastomer 4 will incline slightly to contact the cover 5. The positive (negative) current from the connecting piece 52 transfers to the second elastomer 4, and then to the contact portion 252 of the conductive piece 25 through the winding portion 41. Then, the positive (negative) end 242 of the light generator 24 acquires negative (positive) power. Thus, the contact end 32 of the first elastomer (floating contact point) 3 connected to the back surface of the rotary portion 23 contacts the wire 121 in the first receiving portion 12 so as to provide negative (positive) power. The power is transferred to the negative (positive) end 241 of the light generator 24 through the first elastomer (floating contact point) 3. Therefore, a signal is outputted. At the same time, the light generator 24 is lighted up so as to control the items in a window or switching the functions.

Furthermore, a limiting resistor (not shown) can be connected to the switch at positions having positive power so as to prevent an overlarge current to destroy the light generator 24. Thereby, the light generator 24 is protected well.

Figure 5:
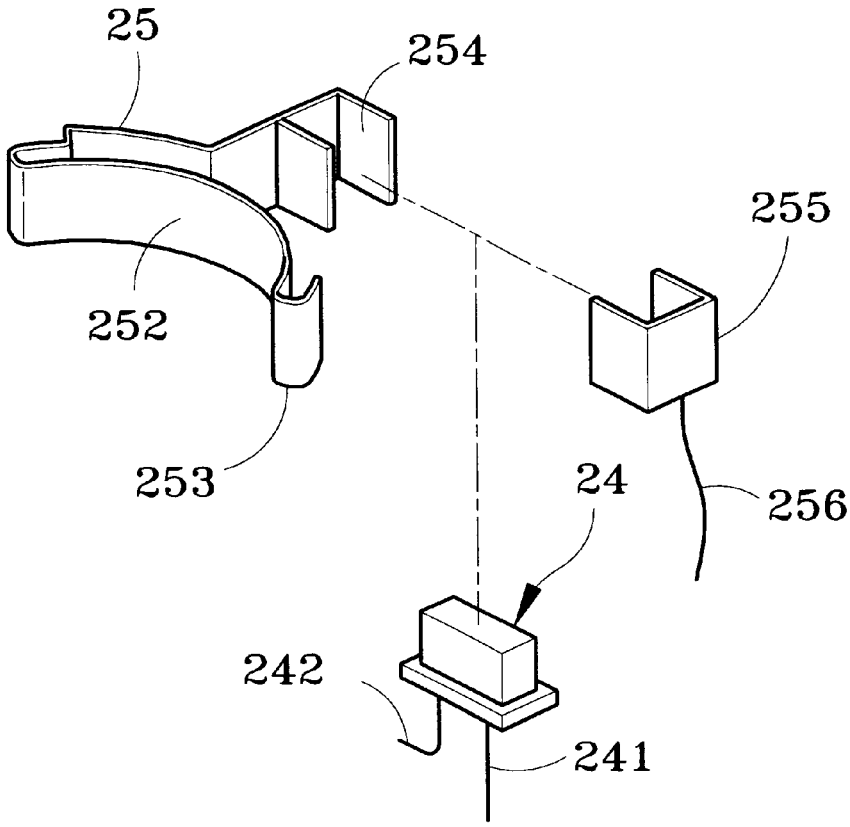
FIG. 5 is a schematic view showing another embodiment of the present invention.

Referring to FIG. 5, a schematic view showing another embodiment of the present invention is illustrated. As shown in the figure, the engaging portion 251 of the conductive piece 25 of the present invention can be divided into two halves 254, 255. The second half 255 is connected to a conductive wire 256 and the first elastomer 3. The second half 255 is connected to the negative (positive) end 241 of the light generator 24. Besides, the first half 254 is connected to the positive (negative) end 242 of the light generator 24. When the key body 2 of the switch is driven by a force, the electric power is transferred to the light generator 24 so that the light generator 24 lights up.

Figure 6:
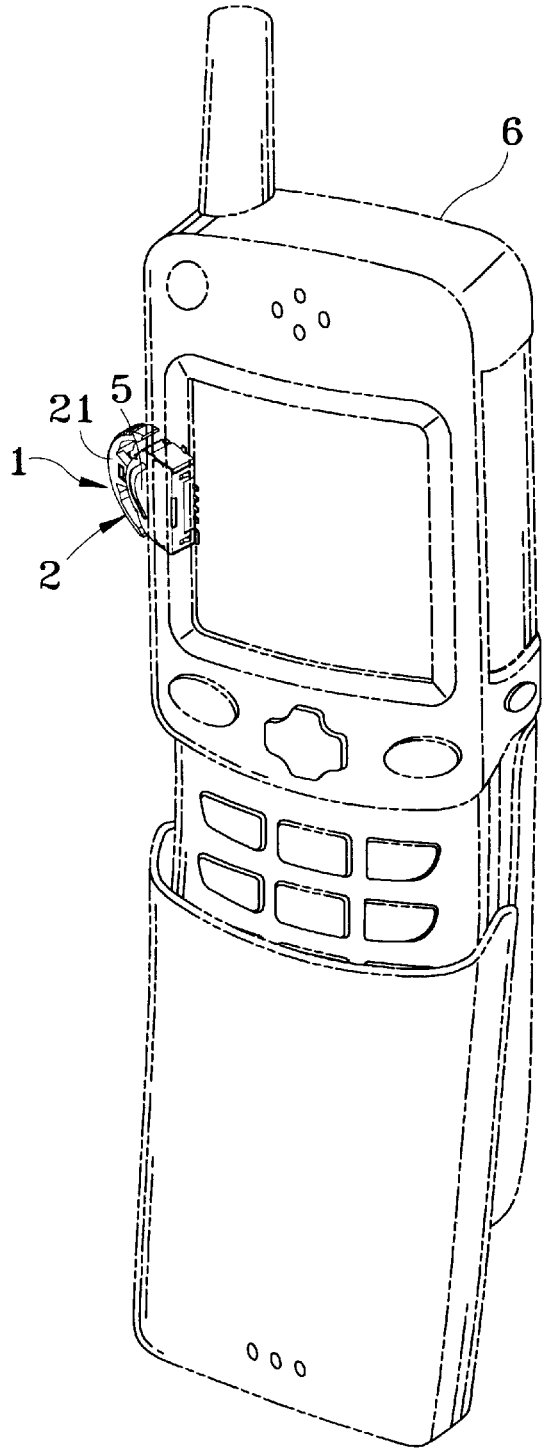
FIG. 6 is a schematic view showing the utilization of the present invention.

Referring to FIG. 6, a schematic view showing the application of the present invention is illustrated. As shown in the figure, the switch of the present invention can be used in a keyboard, a notebook computer, or a palmtop computer, or a mobile phone 6. As the key body 2 of the switch is pushed, it can be used to select the functions on a window or switching the operation. Meanwhile, the light from the light generator 24 may present a vivid feeling to the user.

Moreover, other than using light emitting diode or bubble, the light generator 24 of the present invention may be a fluorescent plate. Furthermore, a light generator 24 with two displaying colors can be used for displaying a correction operation and an incorrect operation.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A switch comprising a seat, a key body, a first elastomer, a second elastomer, and a cover, wherein as the key body is pushed, an electric signal is outputted for switching various functions or selecting various operations;

a neck portion of the key body has an assembling portion, the assembling portion is installed with an embedding portion; a conductive piece is embedded into the embedding portion; one end thereof has an engaging portion connected to the assembling portion; and another end thereof has a contact portion arranged on a bottom of the neck portion;

a light generator is arranged on the engaging portion; the light generator has a positive end and a negative end which are capable of being connected to the embedding portion or the first elastomer;

the cover is installed with a plurality of buckling portions, one of the buckling portions is connected to a conductive piece;

thereby, as the key body is pushed, the second elastomer will contact the cover; the positive (negative) power connected to the conductive piece will be transferred to the positive (negative) end of the light generator; at the same time, the first elastomer contacts internal wires of a first receiving portion so as to provide negative (positive) power to the negative (positive) ends of the light generator; then, electric signals are outputted and the light generator lights up.

2. The switch as claimed in claim 1, wherein a positive end of the switch is connected to a current limiter.

3. The switch as claimed in claim 1, wherein the light generator is one of a light emitting diode, a bubble, and a florescent plate.

4. The switch as claimed in claim 1, wherein the light generator with two displaying colors is used for displaying a correction operation and an incorrect operation.

5. The switch as claimed in claim 1, wherein one end of the contact portion has a buckling portion.

6. The switch as claimed in claim 1, wherein the switch is used in one of a keyboard, a notebook computer, a palmtop computer, and a mobile phone.

7. A switch comprising a seat, a key body, a first elastomer, a second elastomer, and a cover, wherein as the key body is pushed, an electric signal is outputted for switching various functions or selecting various operations;

a neck portion of the key body has an assembling portion, the assembling portion is installed with an embedding portion; a conductive piece is embedded into the embedding portion; one end thereof has an engaging portion formed by a first half and a second half; the second half is connected to a conductive wire connected to the first elastomer; and another end thereof has a contact portion arranged on a bottom of the neck portion;

a light generator is arranged on the engaging portion; the light generator has a positive end and a negative end which are capable of being connected to the first and second halves; and the cover is installed with a plurality of buckling portions, one of the buckling portions is connected to a conductive piece;

thereby, as the key body is pushed, the second elastomer will contact the cover; the positive (negative) power connected to the conductive piece will be transferred to the positive (negative) end of the light generator; at the same time, the first elastomer contacts internal wires of a first receiving portion so as to provide negative (positive) power to the negative (positive) ends of the light generator; then, electric signals are outputted and the light generator lights up.

8. The switch is claimed in claim 1, wherein the positive (negative) power is transferred to the positive (negative) end of the light generator through the second elastomer, and the negative (positive) power to the negative (positive) ends of the light generator is transferred through the first elastomer.

9. The switch is claimed in claim 7, wherein the positive (negative) power is transferred to the positive (negative) end of the light generator through the second elastomer, and the negative (positive) power to the negative (positive) ends of the light generator is transferred through the first elastomer.

* * * * *